US009134654B2

(12) United States Patent
Yoneda et al.

(10) Patent No.: US 9,134,654 B2
(45) Date of Patent: Sep. 15, 2015

(54) DEVELOPER COLLECTION APPARATUS AND IMAGE FORMING APPARATUS

(71) Applicant: KYOCERA Document Solutions Inc., Osaka (JP)

(72) Inventors: Shinsaku Yoneda, Osaka (JP); Shuji Osaki, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/525,504

(22) Filed: Oct. 28, 2014

(65) Prior Publication Data

US 2015/0117895 A1 Apr. 30, 2015

(30) Foreign Application Priority Data

Oct. 31, 2013 (JP) ..... 2013-226706

(51) Int. Cl.

| | |
|---|---|
| ***G03G 21/00*** | (2006.01) |
| ***G03G 15/095*** | (2006.01) |
| ***G03G 15/08*** | (2006.01) |
| ***G03G 21/12*** | (2006.01) |
| ***G03G 21/10*** | (2006.01) |
| *G03G 21/20* | (2006.01) |

(52) U.S. Cl.

CPC ..... *G03G 15/095* (2013.01); *G03G 15/0898* (2013.01); *G03G 21/10* (2013.01); *G03G 21/12* (2013.01); *G03G 21/206* (2013.01)

(58) Field of Classification Search

CPC ... G03G 15/0898; G03G 21/10; G03G 21/12; G03G 21/206; G03G 15/095

USPC ..... 399/92, 93, 99

See application file for complete search history.

(56) References Cited

U.S. PATENT DOCUMENTS

| | | | | |
|---|---|---|---|---|
| 2011/0103821 | A1* | 5/2011 | Akiyama | 399/93 |
| 2012/0230720 | A1* | 9/2012 | Murano | 399/92 |
| 2013/0243472 | A1* | 9/2013 | Yamashita et al. | 399/98 |

FOREIGN PATENT DOCUMENTS

| | | |
|---|---|---|
| JP | 2007-298782 | 11/2007 |

* cited by examiner

*Primary Examiner* — David Gray
*Assistant Examiner* — Thomas Giampaolo, II
(74) *Attorney, Agent, or Firm* — Wenderoth, Lind & Ponack, L.L.P.

(57) ABSTRACT

A developer collection apparatus is provided with a suction duct, a collection box, and an auxiliary fan. One end of the suction duct is arranged near a developing unit. The collection box is connected to the other end of the suction duct and includes a suction fan, where a developer around the developing unit is suctioned and collected via the suction duct by using the suction fan. The auxiliary fan blows air through the suction duct at a certain middle point thereof.

5 Claims, 9 Drawing Sheets

DEVELOPER COLLECTION APPARATUS AND IMAGE FORMING APPARATUS

CROSS-REFERENCE TO RELATED APPLICATION

This application is based upon and claims the benefit of priority from Japanese Patent Application No. 2013-226706 filed on Oct. 31, 2013, the entire contents of which are incorporated herein by reference.

BACKGROUND

The technology of the present disclosure relates to a developer collection apparatus and an image forming apparatus including the same.

Conventionally, there is known a developer collection apparatus that suctions and collects a toner (developer) scattered from a developing unit in an image forming apparatus. The developer collection apparatus is provided with a toner suction duct having a suction port arranged near a developing unit, and a toner collection unit that is connected to the toner suction duct and that suctions and collects a scattered toner from the developing unit via the toner suction duct.

SUMMARY

A developer collection apparatus according to one aspect of the present disclosure includes a suction duct, a collection box, and an auxiliary fan. One end of the suction duct is arranged near a developing unit. The collection box is connected to the other end of the suction duct and includes a suction fan, where a developer around the developing unit is suctioned and collected via the suction duct by using the suction fan. The auxiliary fan blows air through the suction duct at a certain middle point thereof.

An image forming apparatus according to one aspect of the present disclosure includes the developer collection apparatus.

DETAILED DESCRIPTION

Hereinafter, the present embodiment will be described in detail with reference to the drawings. It is noted that the technology of the present disclosure is not limited to the following embodiments.

Figure 1:
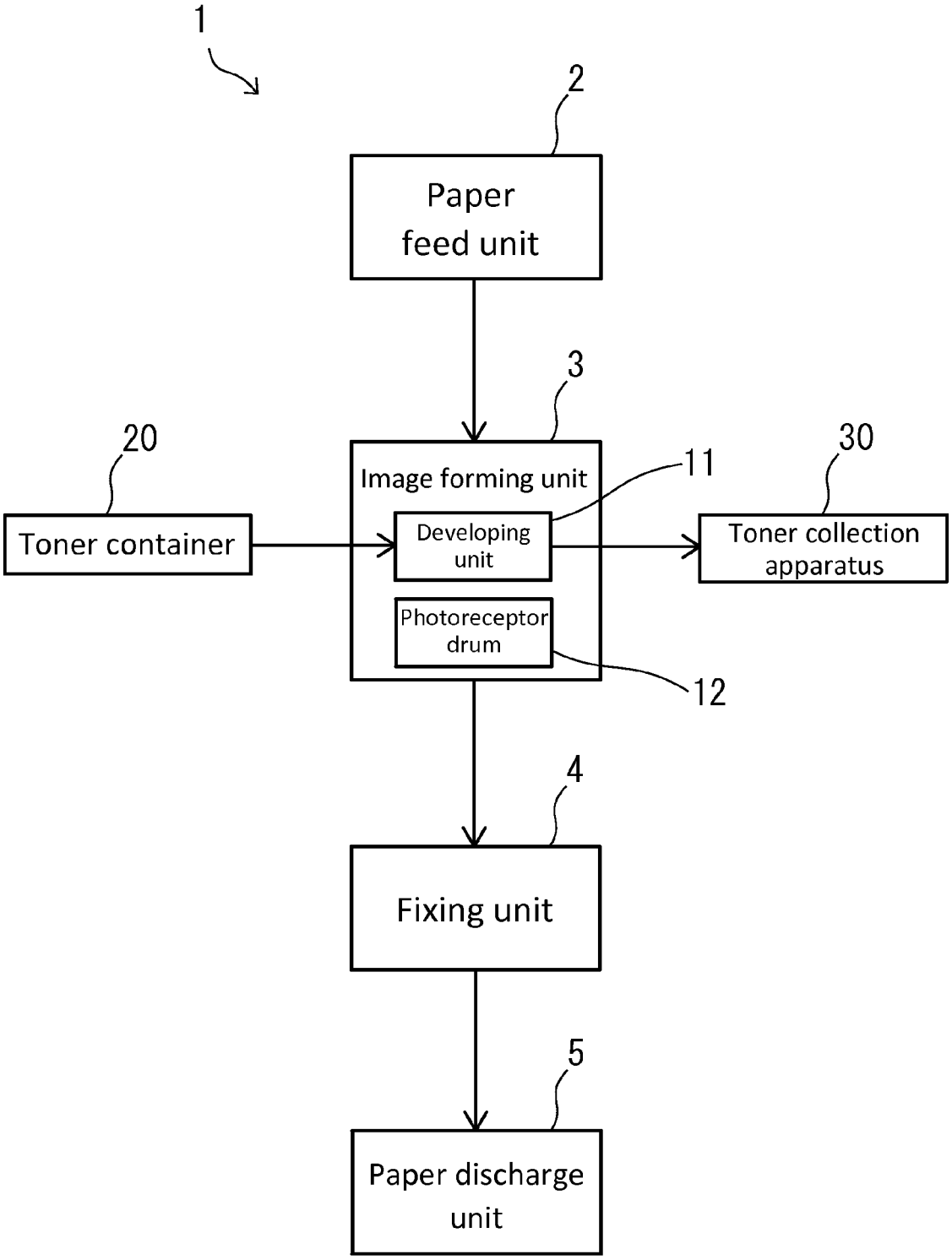
FIG. 1 is a block diagram showing the configuration of an image forming apparatus.

An image forming apparatus 1 of the present embodiment is a laser printer and a multifunction peripheral, for example, and is configured to form an image on a paper, while being conveyed, on the basis of image data transmitted from a terminal, etc. (not shown). As shown in FIG. 1, the image forming apparatus 1 is provided with a paper feed unit 2, an image forming unit 3, a fixing unit 4, and a paper discharge unit 5.

The paper feed unit 2 is a cassette paper feed unit or a manual feed tray that supplies the image forming unit 3 with a paper. The image forming unit 3 is provided with a developing unit 11 and a photoreceptor drum 12 (photoreceptor), for example. In the image forming unit 3, an electrostatic latent image is formed by an optical scanner (not shown) on the photoreceptor drum 12, and the electrostatic latent image is developed by the developing unit 11 to become a toner image, which is an image of the developer. The toner image is transferred to a paper supplied from the paper feed unit 2. The fixing unit 4 is provided with a fixing roller and a pressure roller (neither is shown in the figure), and the toner image transferred by the image forming unit 3 to the paper is fixed onto the paper. As a result, the image is formed on the paper. The paper discharge unit 5 includes a paper discharge tray (not shown) to which the paper having the image formed thereon is supplied from the fixing unit 4.

Further, the image forming apparatus 1 is provided with a toner container 20 and a toner collection apparatus 30 (developer collection apparatus). In the toner container 20, a toner as a developer to be supplied to the developing unit 11 is contained. The toner collection apparatus 30 is for suctioning and collecting a toner (developer) scattered from the developing unit 11.

The configuration of the toner collection apparatus 30 will be described with reference to FIG. 2 to FIG. 9.

As shown in FIG. 2, and FIG. 5 to FIG. 7, etc., the toner collection apparatus 30 is provided with a collection box 40 of the toner, and a suction duct 31 and an exhaust duct 35 connected to the collection box 40.

Figure 3:
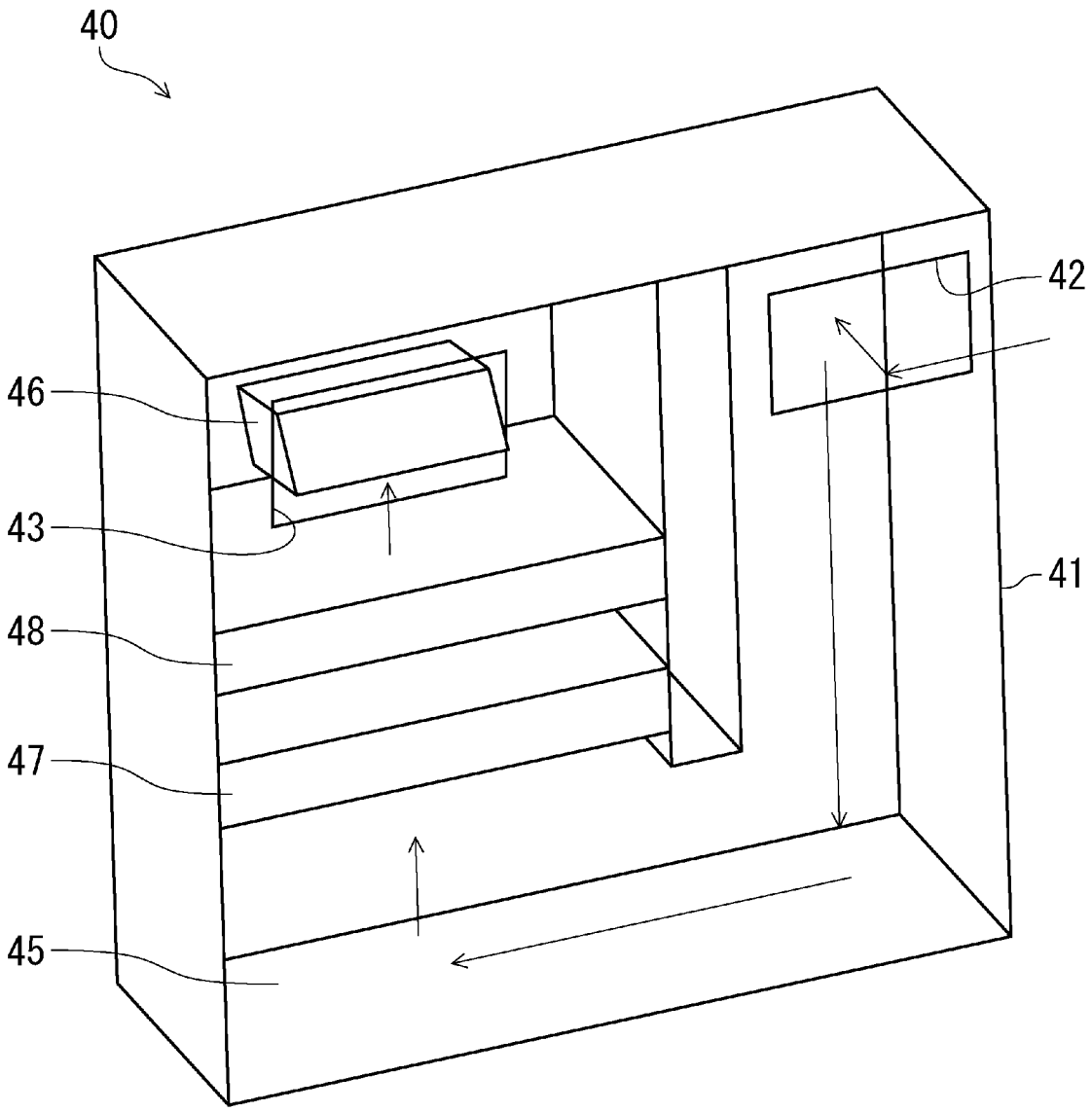
FIG. 3 is a perspective view showing the configuration of a collection box.

As shown in FIG. 3, the collection box 40 is provided with a box body 41 formed in a rectangular box-like shape. Inside the box body 41, a channel 45 of substantially U-lettered shape is formed by a channel forming member 44. In the box body 41, an entry 42 is formed at a position corresponding to one end of the channel 45, and an exit 43 is formed at a position corresponding to the other end of the channel 45. The suction duct 31 is connected to the entry 42, and the exhaust duct 35 is connected to the exit 43. The one end of the suction duct 31 is located near the developing unit 11 so as to be capable of suctioning the toner scattered from the developing unit 11 (see FIG. 5).

The box body 41 houses a suction fan 46 (suction mechanism), and two filters 47 and 48 that absorb the toner. The suction fan 46 is arranged at a position corresponding to the exit 43 in the channel 45. The two filters are an upstream filter 47 and a downstream filter 48, and arranged in order at upstream (that is, at a suction side) of the suction fan 46 in the channel 45.

In the toner collection apparatus 30, when the suction fan 46 is driven, the toner scattered from the developing unit 11, together with the air, is suctioned through the suction duct 31 to the collection box 40. In the collection box 40, the suctioned toner is absorbed by the upstream filter 47 through the channel 45. The toner, which passes through the upstream filter 47 as it is not absorbed thereby, is absorbed by the downstream filter 48. On the other hand, the air suctioned, together with the toner, to the collection box 40 passes through the two filters 47 and 48 in order, and flows from the exit 43 to the exhaust duct 35. The air flown to the exhaust duct 35 is discharged, finally, to outside of the image forming apparatus 1. Thus, the collection box 40 collects the toner scattered from the developing unit 11 (toner around the developing unit 11) by suctioning the toner by the suction fan 46 and absorbing the suctioned toner by the filters 47 and 48.

Figure 4:
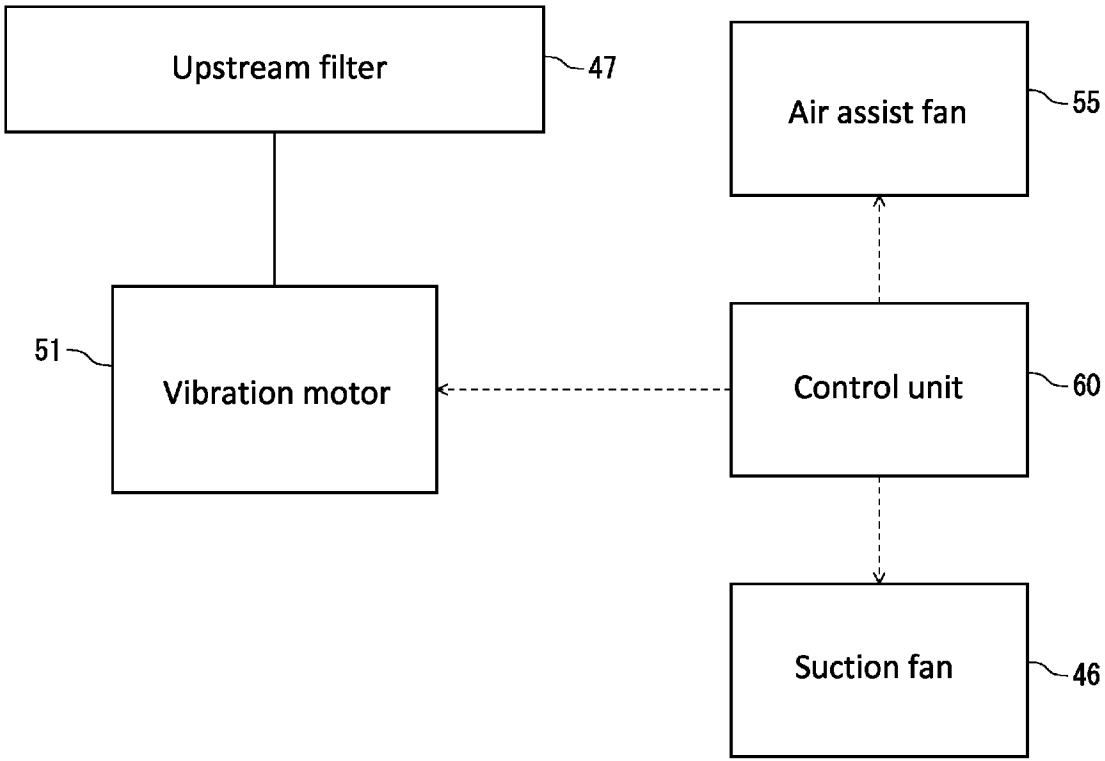
FIG. 4 is a block diagram showing a drive system of a toner collection apparatus.
Figure 5:
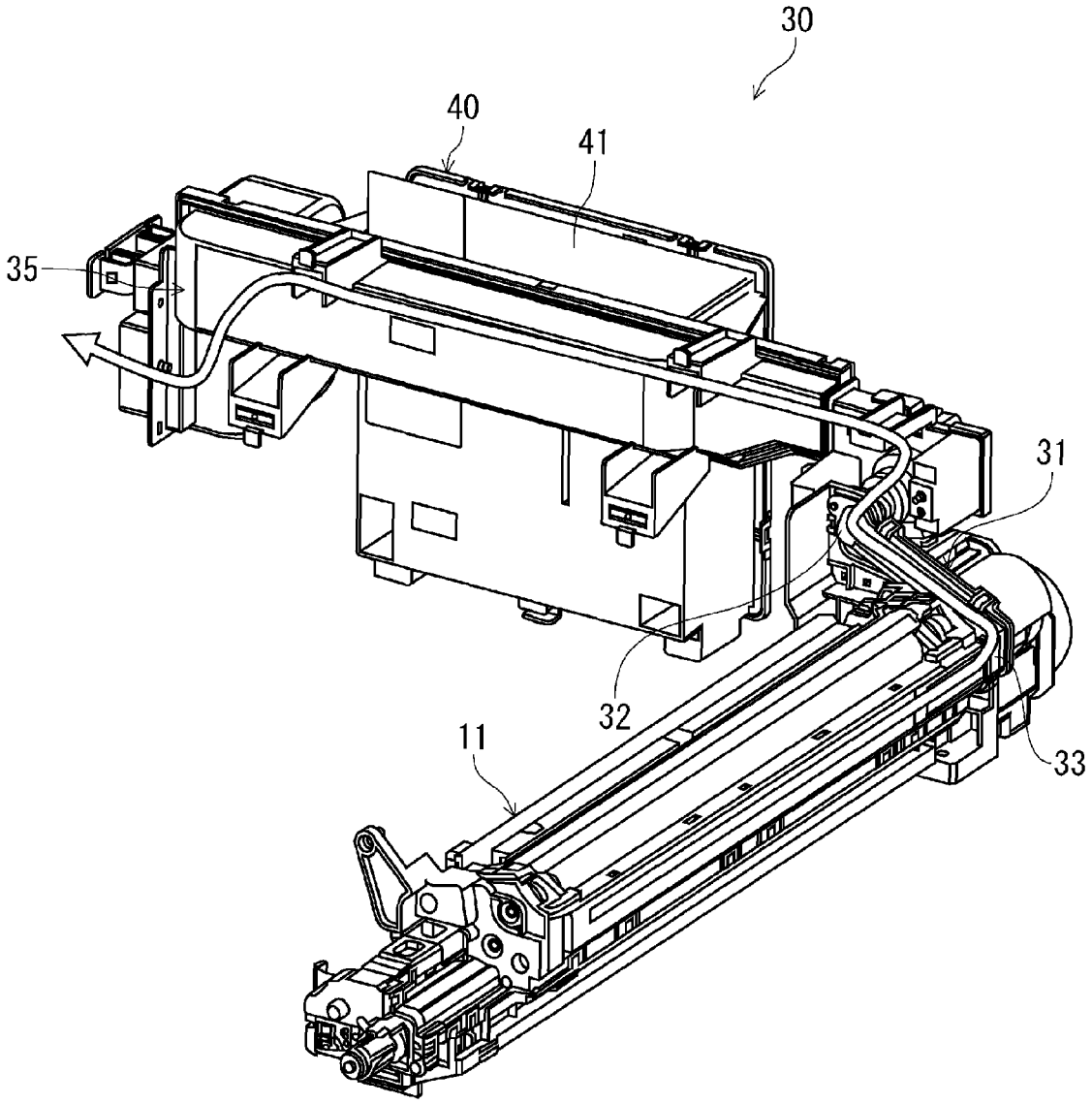
FIG. 5 is a perspective view showing the configuration of a toner collection apparatus and a developing unit.
Figure 6:
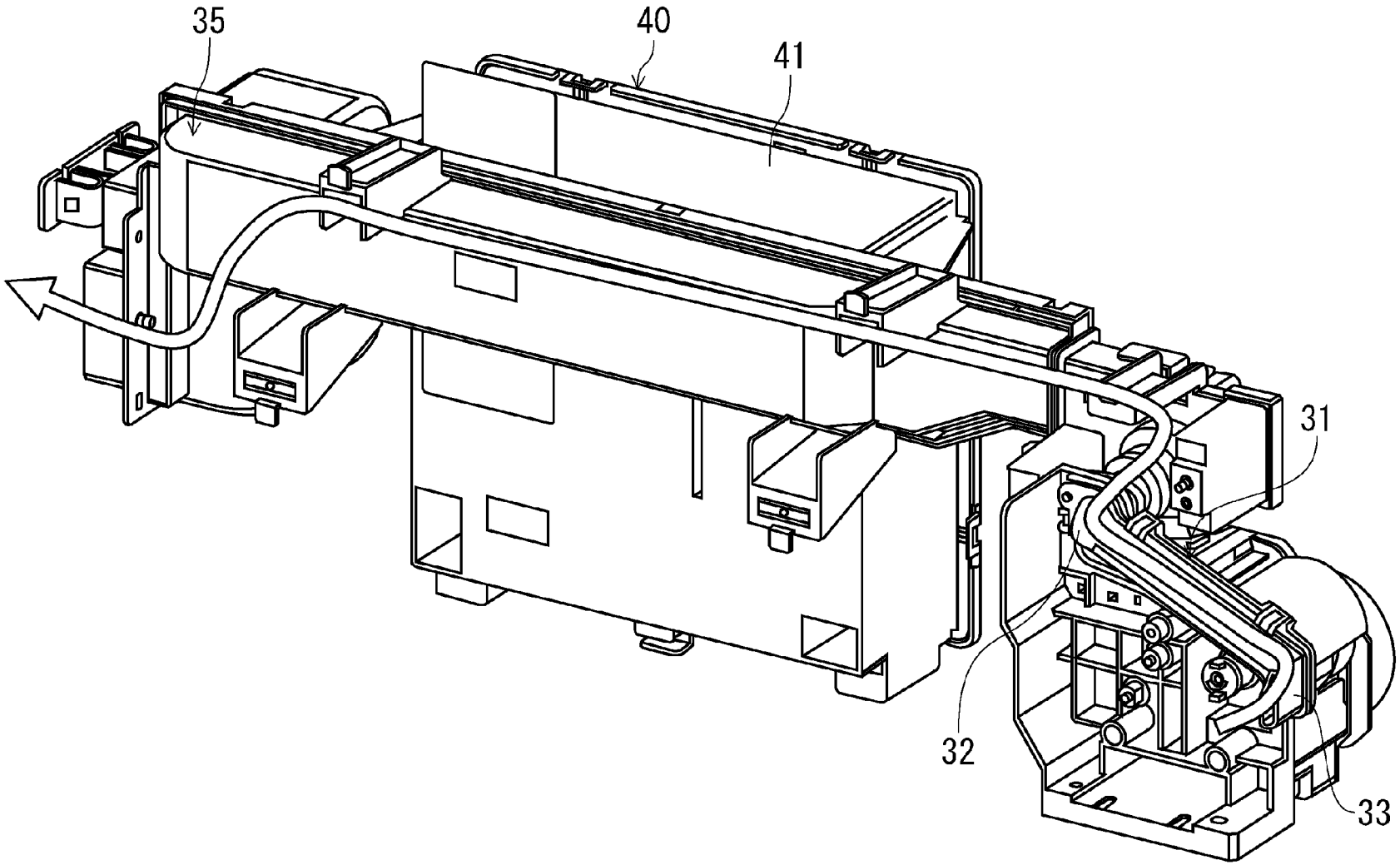
FIG. 6 is a perspective view showing the configuration of a toner collection apparatus.
Figure 7:
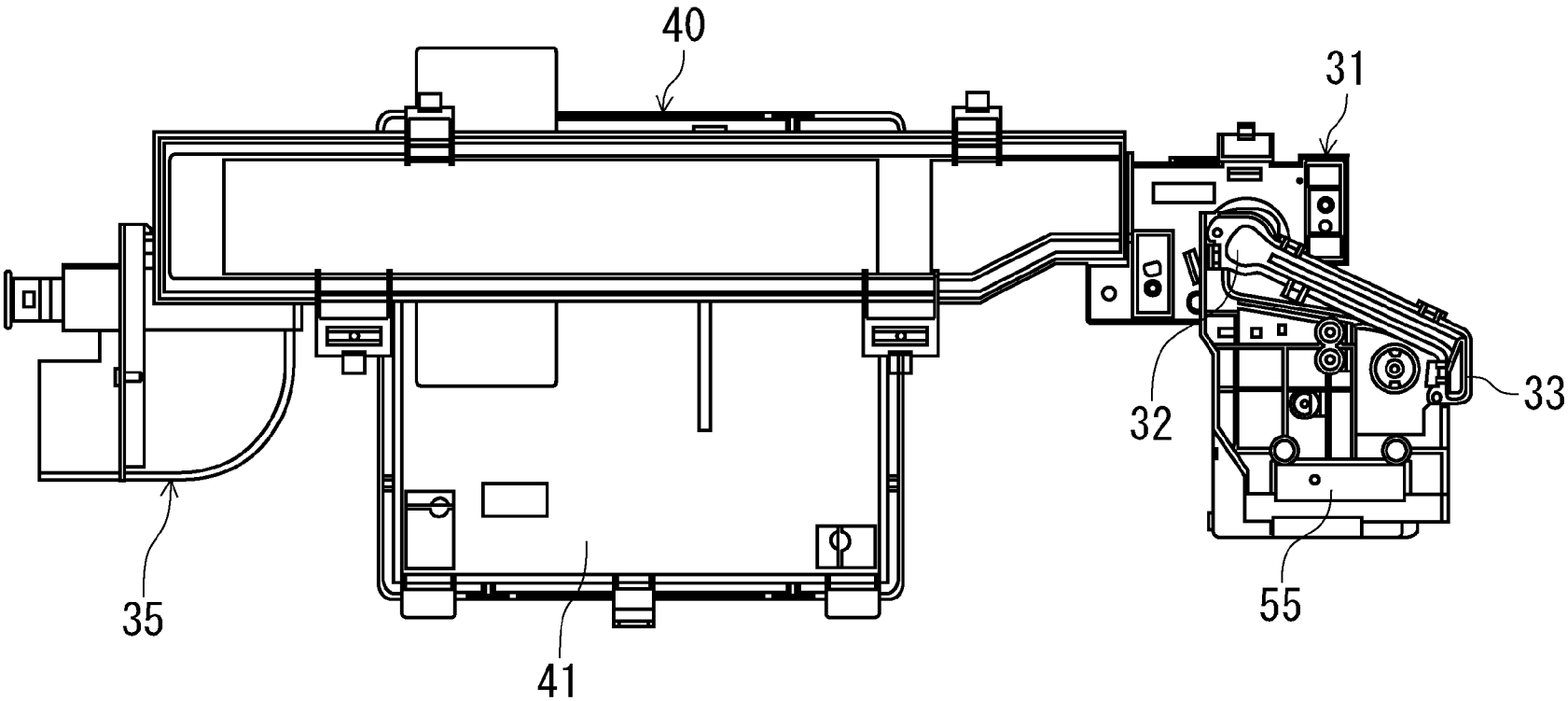
FIG. 7 is a front view showing the configuration of a toner collection apparatus.

Further, as shown in FIG. 4, the toner collection apparatus 30 is provided with a vibration motor 51 (vibration mechanism) that vibrates the upstream filter 47, an air assist fan 55 (auxiliary fan), and a control unit 52.

The vibration motor 51 is configured to vibrate the upstream filter 47 to shake off the toner absorbed to the upstream filter 47. This restrains clogging in the upstream filter 47 by the toner.

Figure 2:
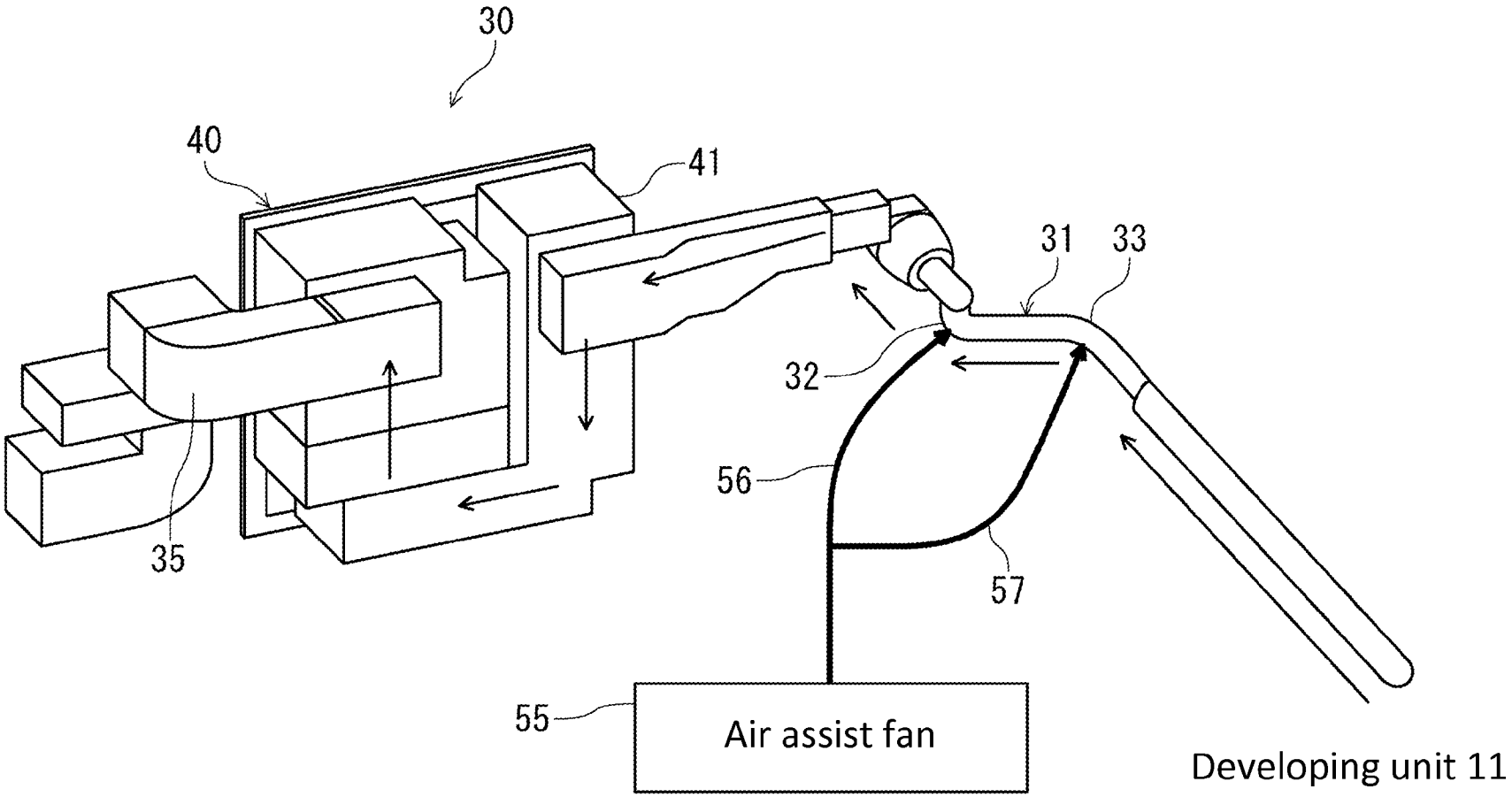
FIG. 2 is a perspective view showing the configuration of a toner collection apparatus.
Figure 8:
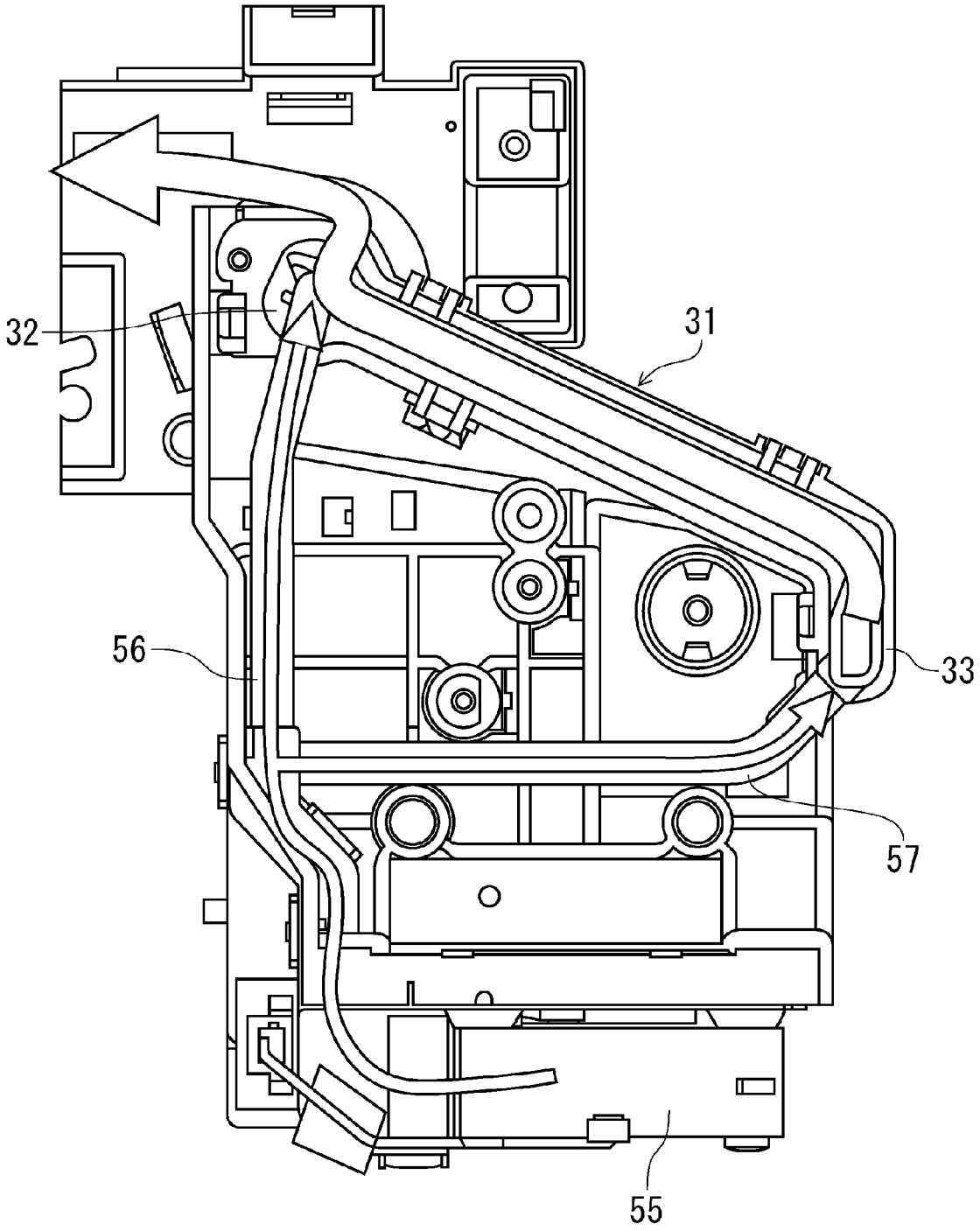
FIG. 8 is a front view showing a main part of a toner collection apparatus.
Figure 9:
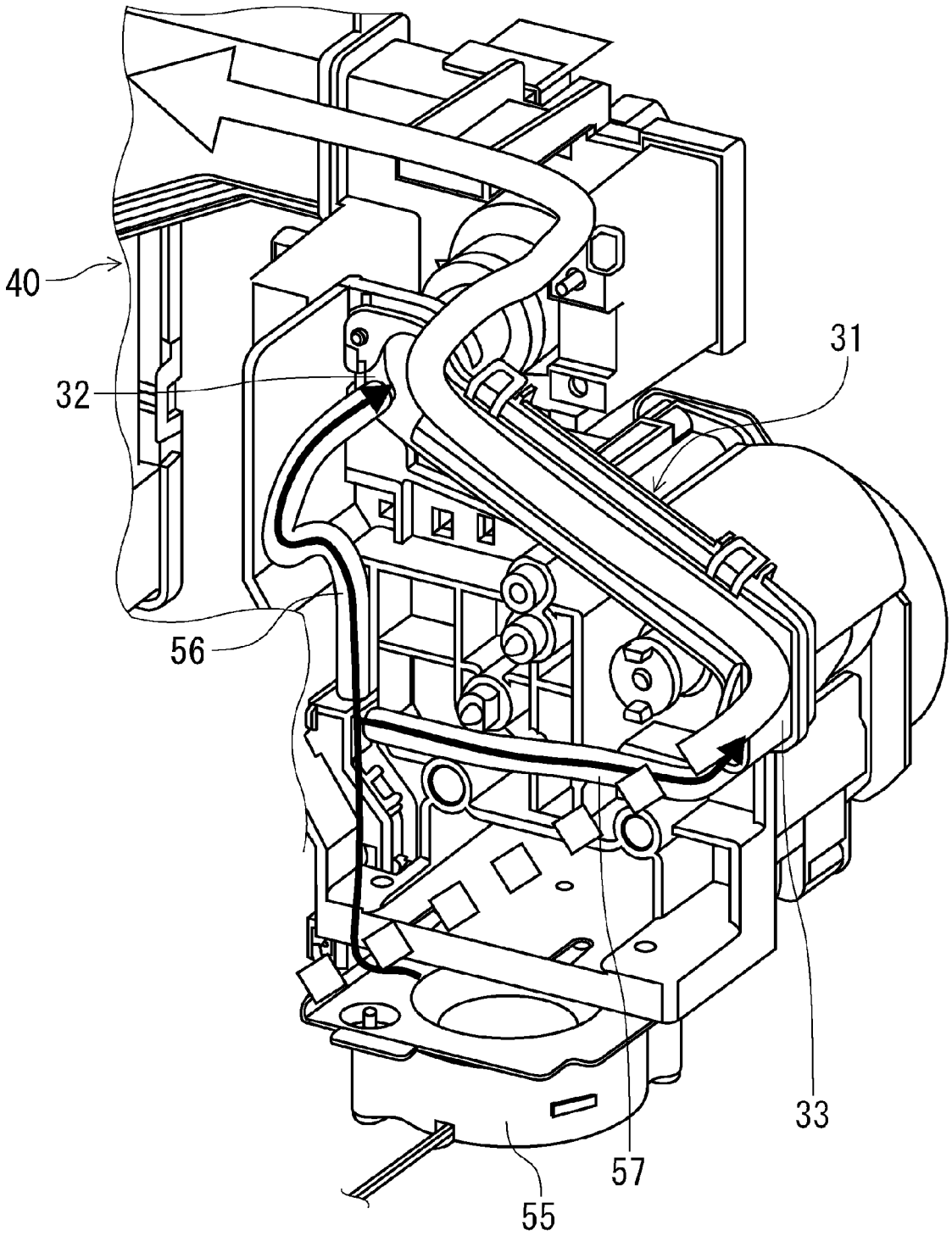
FIG. 9 is a perspective view showing a main part of a toner collection apparatus.

As shown in FIG. 2, FIG. 8, and FIG. 9, etc., the air assist fan 55 blows the air through the suction duct 31 at a certain middle point thereof to wind up the toner accumulated inside the duct by the blowing air.

Specifically, the suction duct 31 includes bent portions 32 and 33 bent substantially at the right angle and slightly upward. The air assist fan 55 includes two blow channels 56 and 57. In the first blow channel 56, one end is connected to the air assist fan 55, and the other end is connected to the first bent portion 32 of the suction duct 31. In the second blow channel 57, one end is connected to a certain middle point of the first blow channel 56, and the other end is connected to the second bent portion 33 of the suction duct 31. That is, the air assist fan 55 is configured to blow the air to the bent portions 32 and 33 in the suction duct 31 through the blow channels 56 and 57.

Further, as shown in FIG. 8 and FIG. 9, the air assist fan 55 is configured to blow the air toward a suction direction of the toner by the suction fan 46. That is, the blow channels 56 and 57 are connected to the bent portions 32 and 33 so that an air blowing direction is the same or substantially the same as the suction direction of the toner. Further, a channel cross-sectional area of the blow channels 56 and 57 is smaller than a channel cross-sectional area of the suction duct 31.

The control unit 60 controls to drive the suction fan 46, the vibration motor 51, and the air assist fan 55. The control unit 60 stops, as a basic control, the suction fan 46 and the air assist fan 55 when the vibration motor 51 is driven. Further, the control unit 60 drives the suction fan 46 when the air assist fan 55 is driven.

Based on the toner collection apparatus 30 according to the above-described embodiment, the air assist fan 55 that blows the air through the suction duct 31 at a certain middle point thereof is arranged, and thus, it is possible to wind up the toner accumulated inside the suction duct 31. As a result, it is possible to easily suction the toner accumulated inside the suction duct 31 by the suction fan 46. Thus, it is possible to restrain the accumulation of the toner inside the suction duct 31, and thus, it is possible to restrain an increase in ventilation resistance inside the suction duct 31. As a result, it is possible to restrain a decrease in toner collection rate.

In addition, in the toner collection apparatus 30 according to the above-described embodiment, the air is to be blown to the bent portions 32 and 33 where the toner is easily accumulated in the suction duct 31, and thus, it is possible to effectively restrain accumulation of the toner in the suction duct 31. In particular, in the present embodiment, the bent portions 32 and 33 are bent upward, and thus, the toner is more easily accumulated; however, it is possible to effectively restrain the accumulation.

Further, in the toner collection apparatus 30 according to the above-described embodiment, the air is to be blown toward the suction direction of the toner by the suction fan 46 in the suction duct 31, and thus, it is possible not only to wind up the accumulated toner by the blowing air but also to flow the accumulated toner toward the collection box 40. That is, it is possible to assist the suction effect by the suction fan 46. Thus, it is possible to more easily suction the toner accumulated inside the suction duct 31 by the suction fan 46.

Moreover, in the toner collection apparatus 30 according to the above-described embodiment, the channel cross-sectional area of the blow channels 56 and 57 is smaller than the channel cross-sectional area of the suction duct 31, and thus, it is possible to easily increase the power to blow air from the blow channels 56 and 57 to the suction duct 31. As a result, it is possible to easily wind up the toner accumulated inside the suction duct 31, and it is possible to more easily suction the toner by the suction fan 46.

Further, in the above-described embodiment, the suction duct 31 has two bent portions 32 and 33, that is, the first bent portion 32 and the second bent portion 33, and the air assist fan 55 includes the first blow channel 56 of which the one end is connected to the assist fan 55 and of which the other end is connected to the first bent portion 32, and the second blow channel 57 of which the one end is connected to a certain middle point of the first blow channel 56 and of which the other end is connected to the second bent portion 33 of the suction duct 31.

According to this configuration, it is possible to blow the air toward the two bent portions 32 and 33 by one air assist fan 55, and thus, as compared to a case where the air assist fan 55 is arranged to each of the bent portions 32 and 33, it is possible to achieve a lower cost by reducing the number of the air assist fans 55.

Further, in the above-described embodiment, the control unit 60 is configured to stop the suction fan 46 and the air assist fan 55 when the vibration motor 51 is driven, and to drive the suction fan 46 when the air assist fan 55 is driven.

According to this configuration, the suction fan 46 and the air assist fan 55 are stopped when the vibration motor 51 is driven, and thus, it is possible to surely shake off, by the vibration motor 51, the toner absorbed to the upstream filter 47 to prevent the clogging. Further, when the air assist fan 55 is driven, the suction fan 46 is driven, and thus, it is possible to surely lead the toner blown away by the air assist fan 55 to the collection box 40 by the suction force of the suction fan 46 so that the toner is collected by the upstream filter 47.

As described above, the technology of the present disclosure is useful for a developer collection apparatus that suctions and collects a developer scattered from a developing unit and an image forming apparatus provided with the same.

What is claimed is:

1. A developer collection apparatus, comprising:

a suction duct of which the one end is arranged near a developing unit;

a collection box that is connected to another end of the suction duct and includes a suction fan, where a developer around the developing unit is suctioned and collected via the suction duct by using the suction fan; and an auxiliary fan that blows air through the suction duct at a certain middle point of the suction duct, wherein the suction duct includes a first bent portion and a second bent portion, the auxiliary fan is configured to blow the air to the first and second bent portions of the suction duct, and the auxiliary fan includes:

a first blow channel having one end that is connected to the auxiliary fan and another end that is connected to the first bent portion of the suction duct; and a second blow channel having one end that is connected to a certain middle point of the first blow channel and another end that is connected to the second bent portion of the suction duct.

2. The developer collection apparatus according to claim 1, wherein the auxiliary fan is configured to blow the air toward a suction direction of the developer by the suction fan.

3. The developer collection apparatus according to claim 1, wherein the auxiliary fan includes a blow channel connected to the certain middle point of the suction duct and is configured to blow the air through the suction duct by way of the blow channel, and a channel cross-sectional area of the blow channel is smaller than a channel cross-sectional area of the suction duct.

4. The developer collection apparatus according to claim 1, further comprising:

a filter arranged upstream of the suction fan in the collection box;

a vibration motor that vibrates the filter to shake off a toner absorbed to the filter; and a control unit that controls to drive the suction fan, the vibration motor, and the auxiliary fan, wherein the control unit stops the suction fan and the auxiliary fan when the vibration motor is driven, and drives the suction fan when the auxiliary fan is driven.

5. An image forming apparatus comprising the developer collection apparatus according to claim 1.

* * * * *